US007182204B2

(12) United States Patent
Schenk

(10) Patent No.: US 7,182,204 B2
(45) Date of Patent: Feb. 27, 2007

(54) TREATMENT METHOD AND DEVICE, IN PARTICULAR FOR EXCAVATION MATERIAL

(76) Inventor: Jürgen Schenk, Hausmannstr. 34, Stuttgart (DE) 70188

( * ) Notice: Subject to any disclaimer, the term of this patent is extended or adjusted under 35 U.S.C. 154(b) by 355 days.

(21) Appl. No.: 10/471,008

(22) PCT Filed: Mar. 8, 2002

(86) PCT No.: PCT/DE02/00826

§ 371 (c)(1),
(2), (4) Date: Sep. 8, 2003

(87) PCT Pub. No.: WO02/072329

PCT Pub. Date: Sep. 19, 2002

(65) Prior Publication Data

US 2004/0091319 A1 May 13, 2004

(30) Foreign Application Priority Data

Mar. 9, 2001 (DE) ..... 101 11 300

(51) Int. Cl.
*B03B 1/04* (2006.01)

(52) U.S. Cl. ..... 209/3; 209/4

(58) Field of Classification Search ..... 209/3, 209/4, 5, 49, 661, 667, 669, 673, 240, 241, 209/242, 247
See application file for complete search history.

(56) References Cited

U.S. PATENT DOCUMENTS 3,812,821 A * 5/1974 Laycock ..... 118/418
4,297,311 A * 10/1981 Sherman et al. ..... 264/109
4,618,414 A * 10/1986 Hartan et al. ..... 209/5
6,444,731 B1 * 9/2002 Memon ..... 524/59
2003/0159975 A1 * 8/2003 Romagnoli ..... 209/225

FOREIGN PATENT DOCUMENTS

| | | |
|---|---|---|
| CH | 690 758 A | 1/2001 |
| DE | 196 27 465 A | 12/1996 |
| EP | 0 675 232 A | 10/1995 |

OTHER PUBLICATIONS

English Translation of EP 0 675 232 A1, Oct. 1995.*
English Translation of DE 196 27 465 A1, Dec. 1996.*

* cited by examiner

*Primary Examiner*—Joseph C. Rodriguez
(74) *Attorney, Agent, or Firm*—Venable LLP; Stuart I. Smith; Ryan M. Flandro

(57) ABSTRACT

A method and an apparatus for processing mixtures of material which contain a coarse component (3) and a predominantly cohesive fine component (4). Both the mixture of material (2) and an added material (5) are delivered in continuous streams of material (11, 23) to a homogenizing and separating device (12). The homogenizing and separating device (12) serves to mix the added material (5) and the mixture of material (2) uniformly with one another, so as to put the fine component (4) of the mixture of material (2) into a state such that the fine components (4) can be separated from the coarse component (3). As a result of the continuous delivery of the mixture of material (2) and added material (5) to the homogenizing and separating device (12), intimate mixing of the added material (5) and fine component (4) is achieved so that the separation of the coarse component and fine component can take place directly in the same device. With this method, mixtures of material (2) can be processed without waste into two re-usable products.

28 Claims, 3 Drawing Sheets

TREATMENT METHOD AND DEVICE, IN PARTICULAR FOR EXCAVATION MATERIAL

BACKGROUND OF THE INVENTION

1. Field of the Invention

The invention relates to a method for processing a mixture of material, in particular for processing a mixture of material which contains at least one coarse component in pieces and one fine component, and to an apparatus for performing the method of the invention.

2. Related Art

Material that contains such coarse components as stones, relatively small pieces of rock or the like, as well as a fine component that adheres or sticks to the coarse component depending on its moisture content, is often processed into other products worth using by separating the components of the material from one another. In practice, both the composition of the starting mixture of material and its moisture content vary considerably from one case to another. Furthermore, such materials often stubbornly resist simple separation. If the fine component adheres to the coarse components, the mixture of material cannot be separated in a screening operation. Even with so-called roller grates, the material in many cases cannot be readily separated. The fine component may cause a cake to form that does not pass through the openings between the driven rollers, and so adequate separation of stones and fine material is not achieved. However, if chisels or other profiled features are provided on the individual rollers of the roller grates, these chisels or features being intended to feed the fine component downward between the driven rollers, then problems can arise with the coarse component, that is, the stones or pieces of rock contained. For material separation, washing methods are therefore often employed, which wash the fine component out of the coarse component in the form of a sludge. However, the sludge is usually not re-usable, so that there are high subsequent costs for disposing of it. Moreover, the high water consumption often stands in the way of economical employment of such methods. Finally, only one part of the starting material, such as the coarse part, is actually used.

From German Patent DE 196 27 465 C2, it is known to use so-called bucket separators for separating material. They are embodied on the order of a dredge or excavator bucket, with at least two driven rollers disposed in the bottom of the bucket. Disks and chisels are disposed on the rollers. For material processing, the mixture of material is picked up with this bucket, and the bucket is pivoted such that the material it contains weighs down on the rollers. As a result of their rotations, the rollers let the fine component drop through between them, while the coarse component remains in the bucket separator and can then be tipped out.

It is also known from DE 196 27 465 C2 to add added material to the material picked up by the bucket separator; a defined portion of this added material is for instance taken from an appropriate silo and then rests on the picked-up material in the bucket separator. The added material is fed along with the fine component through the bucket separator and separated from the coarse component. Initially, approximately ⅓ of the picked-up material is fed through the bucket separator without added material. To achieve complete mixing of the added material and the fine component, it is necessary as a rule for the finer material that is discharged from the bucket separator to be picked up again by the bucket and made to pass between the rollers. This operation may have to be repeated several times.

From German Patent DE 199 25 502 C1, a method for recovering oil from drilling sludge and/or oil-containing drilling sludge fractions is also known. In this method, coal dust is added to the drilling sludge. Next, the resultant suspension is mixed, after which the mixture is divided into a lightweight and a heavy fraction of coal dust and oil. The coal dust and oil fraction is then separated out by desorption or extraction.

BRIEF SUMMARY OF THE INVENTION

It is an object of the invention to create a processing method for processing a mixture of material which contains at least one lumpy coarse component and one sticky fine component, where from the two components, a re-usable product is to be produced, and the method is meant to be both rational and largely insensitive to fluctuations in quality of the mixture of material to be processed.

The method of the invention processes the mixture of material continuously. To that end, both the mixture of material to be processed and an added material are delivered, each as a continuous stream of material, to a homogenizing and separating device. This enables the homogenizing and separating device to distribute the added material uniformly in the mixture of material, making the mixture of material separable. For instance, a water-binding added material can be added, to reduce the stickiness of the cohesive component. The uniform distribution of the added material in the mixture of material is thus essential for good separability of the entire coarse component from the entire fine component. Moreover, in this way, not only is the coarse component obtained as a re-usable product, but the fine component provided with added material is also obtained with an adequate degree of homogenization, so that posttreatment of the fine component can be dispensed with. Sludge does not occur. This is particularly due to the fact that no water is admixed with the mixture of material.

In the homogenizing and separating device, a flow equilibrium ensues between the streams of material that are delivered and the streams of material that are carried away. Thus the conditions in the homogenizing and separating device during operation of the system can be adjusted to be essentially constant. These conditions include the quantity of material present in the homogenizing and separating device, its composition, its speed and direction of motion, the moisture content of the mixture, and the composition of the mixture.

In contrast to known methods, the material components forming the mixture can be separated from one another in a single pass through the system and converted into separately re-usable products. Moreover, no unusable wastes, such as sludges or the like, are created.

The homogenizing and separating device has a homogenizing segment that extends from an entrance to an exit. The mixture of material and the added material pass through the homogenizing segment in the same direction. Over the entire length of the homogenizing segment, separation exits branch off, formed for instance by interstices between rotating shafts.

A moisture-regulating material is preferably used as the added material, such as quicklime in powder or granulate form, cement, ash, rock dust, granulates, fibers (cellulose or other fibers), wood chips, wood dust, suspensions such as lime sludge, bentonite, or sealing suspensions, for instance plastic-based. The added materials are preferably selected such that they can better separate the fine and the lumpy components from one another, and that the fine component, once it has been separated from the lumpy component, has the requisite or desired physical properties, such as load-bearing ability or imperviousness.

In a preferred embodiment, the metering of the quantity of added material delivered per unit of time is done either constantly or from time to time on the basis of the water content of the mixture of material to be processed. A moisture measuring sensor can be used for the purpose, connected to a central controller. Alternatively, the moisture can be ascertained by taking samples and then examining them. From the physical properties of the sample (moldability) or directly measured moisture content), it is possible to determine the appropriate quantity of added material, for instance with reference to a table, and input it via an input device to the central controller of the processing system. Alternatively, the system can be such that the ascertained moisture content of the mixture of material is input, after which the central control device determines the requisite quantity of added material from internal calculation rules or tables.

It is furthermore possible for the streams of material to be delivered to the homogenizing and separating device in controlled fashion in such a way that only as much material is delivered as leaves the homogenizing and separating device on the exit side. In this way, fluctuations in the separating speed, for instance resulting from fluctuations in quality of the mixture of material, can be compensated for.

It is preferred that both the mixture of material and the added material be delivered jointly in a single stream of material to the homogenizing and separating device. As a rule, this results in especially good homogenization and mixing of the added material and the fine component. The size of the delivered stream of the mixture of material is regulated, for instance by way of the layer height on a conveyor belt delivering it. In a preferred variant embodiment of the method, the layer height is made approximately as large as the greatest diameter of the pieces that form the lumpy component of the material. This represents the least possible layer thickness for an unimpeded process.

Preferably, a delivery of mixture of material is used in which the layer height of the mixture of material, for instance resting on a conveyor belt and delivered on it, is adjusted to be as slight as possible. The width of the conveyor belt, conversely, can be substantially greater. It is possible for the added material to be applied merely as a narrow strip on the mixture of material. However, it is preferable for it to be applied over the full width, so that to the limits of accuracy of this technical process, the same uniform layer height of the mixture of material, with a uniform covering (layer height) of the added material, is obtained over the full width of the conveyor belt delivering it. This creates the best preconditions for good homogenization and thus also good separating action of the homogenizing and separating device.

An apparatus is further provided for performing the method of the invention having at least one homogenizing and separating device, one material delivery device, and one added material metering device. These devices are embodied such that they each operate continuously; that is, they deliver material and added material to the homogenizing and separating device without pause, and the homogenizing and separating device operates without pause, that is, in a continuous process. In order to obtain an effectively continuous homogenizing and separating process even if material is supplied discontinuously, it is considered advantageous to dispose a roller grate in the supply container. The roller grate enables both delivery of material in a way that is made uniform and the ejection of overly large components of material.

The material delivery device is formed for instance by a belt conveyor and optionally a separator device upstream of it. The material delivery device continuously conveys a stream of a mixture of material even when material is input discontinuously. To adjust the feeding stream, a constant material height on the conveyor belt can be established, for instance via a slide or a screen. The belt conveyor can also be embodied as a weighing conveyor. Preferably, a feed hopper is disposed above the conveyor belt. If it is expected that the mixture of material contains coarse components, then it is considered advantageous to dispose a roller grate in or above the feed hopper, in order to eject all the overly large components at the side. This prevents very coarse components from interfering with the feeding process in the delivery of the mixture of material. Moreover, the roller grate disposed above the belt conveyor acts as a material buffer. Material fed discontinuously and in great quantity onto the roller grate is discharged already relatively uniformly from the roller grate to the belt conveyor of the material delivery device.

It is considered especially advantageous for the roller grate of the material delivery device to be embodied as adjustable in its inclination. Thus the capacity can be adapted to different feed streams and qualities of material. The axes of rotation of the rollers are preferably disposed horizontally, while the conveying direction (horizontally, rising or falling) is intended to be adjustable. The roller spacings are preferably fixed, but can also be set adjustably. The roller spacings can be set to match one another. Instead of the roller grate for ejecting the coarsest component, a splitter or breaker device can be provided, which has at least two parallel shafts that carry wedge elements. The wedge elements are oriented obliquely to the radial direction and obliquely to the circumferential direction and serve to split off the very large components (the coarsest component, that is, stones or pieces of rock whose diameter is greater than the maximum layer thickness on the conveyor belt of the delivery device). Preferably, a splitter device of this kind is set up to limit the maximum particle size to approximately 200 mm, or in other to words to split larger pieces and to convey smaller material unaffected onward.

A roller grate, disk separator or similar arrangement can be used as the homogenizing and separating device. A common feature of all of these is that they have a plurality of shafts that are parallel to one another and are preferably driven to rotate in the same direction. The shafts carry separator elements, such as disks, disks provided with chisels, or nonround elements, for instance elliptical elements. Because of the rotation in the same direction, the shafts and the separator elements define a feeding direction. The mixture of material and the added material are delivered to the beginning of the feed path thus formed. The coarse component is removed on the opposite end of the feed path. This can be done either continuously or discontinuously. A discharge device serves to control this process. The separator elements can be provided with protrusions, such as chisels, pins, fingers or the like. This improves both the separator action and the homogenizing action.

As needed, the apparatus of the invention may have a sensor device, which via a control device controls the size of the added stream of material in proportion to the stream comprising the mixture of material to be processed. This then makes a fully automated mode of operation possible, because the quantity of added material required for optimal separation of the components of the material is metered automatically.

Further details of advantageous embodiments of the invention are the subject of the ensuing description and drawings.

BRIEF DESCRIPTION OF THE DRAWINGS

Exemplary embodiments of the invention are illustrated in the drawings.

DETAILED DESCRIPTION OF THE INVENTION

Figure 1:
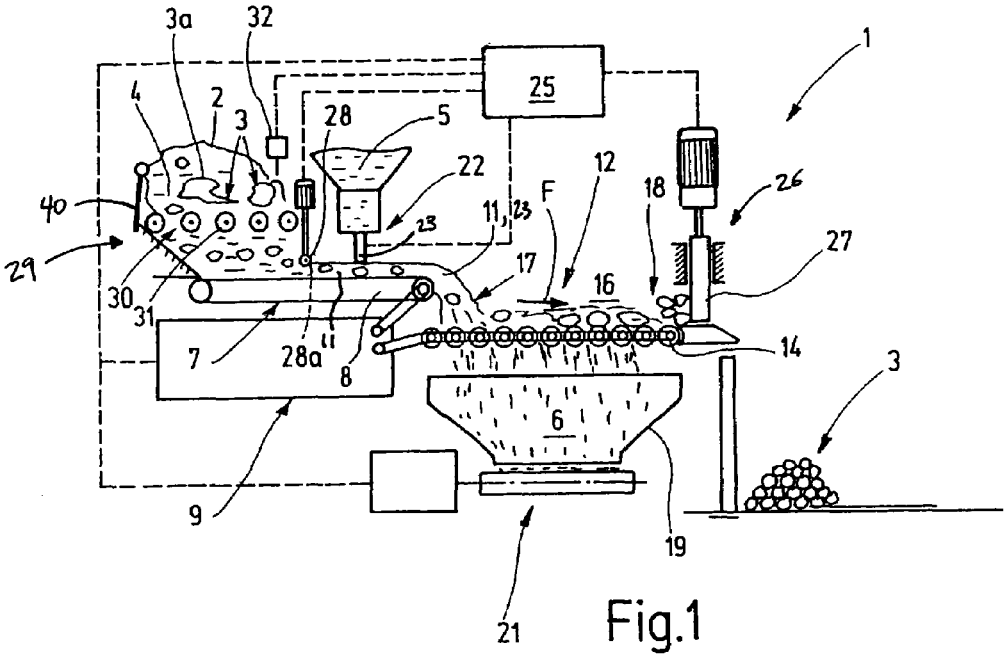
FIG. 1 depicts a schematic illustration of an apparatus for processing a mixture of material.

In FIG. 1, a processing apparatus 1 is shown which serves in particular to process mixtures of material 2 that contain a coarse component 3 and a fine component 4. The coarse component 3 is composed for instance of stones, pieces of rock or other solid components of the mixture of material 2. The mixture of material 2 is for instance excavated soil, which has a fine component 4 such as mud or clay. The mud or clay component causes cohesiveness or a certain stickiness of the mixture of material 2 or fine component 4, depending on the moisture present.

Figure 4:
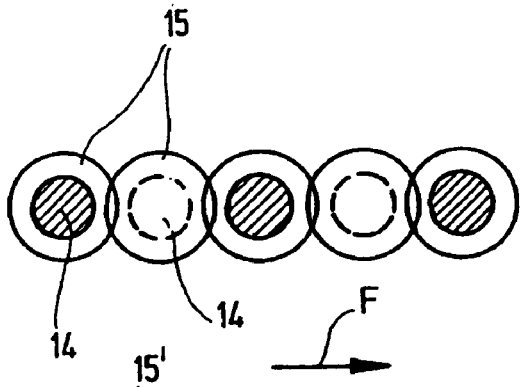
FIG. 4 depicts a schematic sectional view of a disk separator as a component of a homogenizing and separating device.

The mixture of material 2 is processed by the processing apparatus 1 in that the coarse component 3 is separated from the fine component 4, indicated on the right in FIG. 1, and is output separately. The fine component 4, conversely, mixed with an added material 5, is also separately discharged as a processed fine component 6. To that end, the processing apparatus 1 has a material delivery device 7, which in the exemplary embodiment is formed by a belt conveyor 8 in conjunction with a drive mechanism 9. This material delivery device 7 serves to direct the mixture of material 2 in a continuous stream of material 11 into a homogenizing and separating device 12. The homogenizing and separating device 12 has a number of shafts 14, disposed horizontally and parallel to one another, which are connected in terms of drive to the drive mechanism 9 or a separate drive mechanism. The shafts rotate uniformly or at increasing rotary speed in the direction of travel, and as FIG. 4 shows, they carry separator elements 15, for instance in the form of disks joined to the shafts in a manner fixed against relative rotation. Above the shafts 14 and separator elements 15, there is a homogenizing chamber 16, through which the mixture of material 2 is fed, in accordance with the rotation of the shafts 14, from an infeed position 17 to a discharge position 18 in the feeding direction F. The mixture of material 2 is circulated in the process, and as a result the fine component 4 for the most part falls out between the shafts 14. Below the path formed by the shafts 14, there is a collector 19, which carries the mixture 6 to a conveyor device 21, for instance in the form of a belt conveyor.

Figure 5:
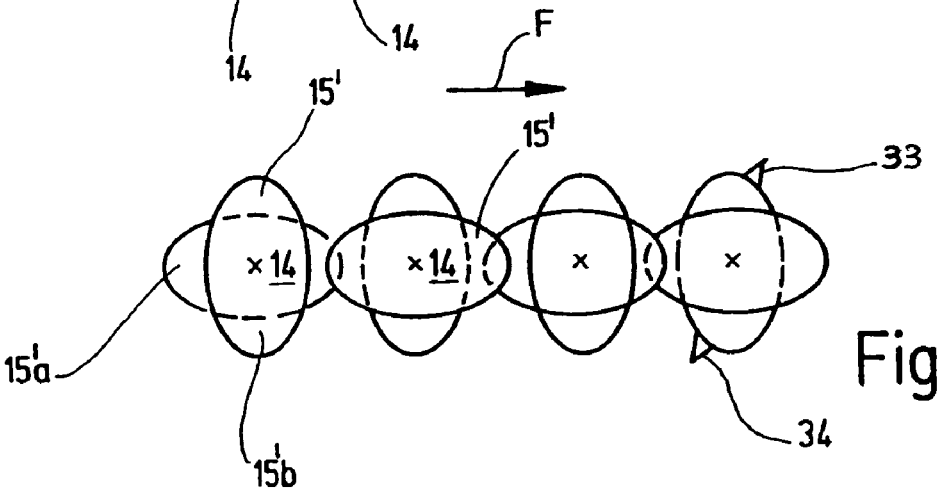
FIG. 5 depicts a schematic side view of a separator with nonround separator elements.

For constantly mixing the added material 5 with the stream of material 11, a metering device 22 for the added material 5 is disposed above the material delivery device 7. The metering device 22 is embodied such that it outputs a continuous stream of material 23, shown for instance in FIG. 3. The metering device 22 can be embodied as a cell wheel sluice. It has a cell wheel 24, which is driven to rotate, for instance under the control of a central control device 25 (FIG. 5). The metering device 22 is preferably embodied such that it places the added material 5 over the full width of the belt conveyor 8 onto the mixture of material 2 resting on the belt conveyor 8.

Figure 3:
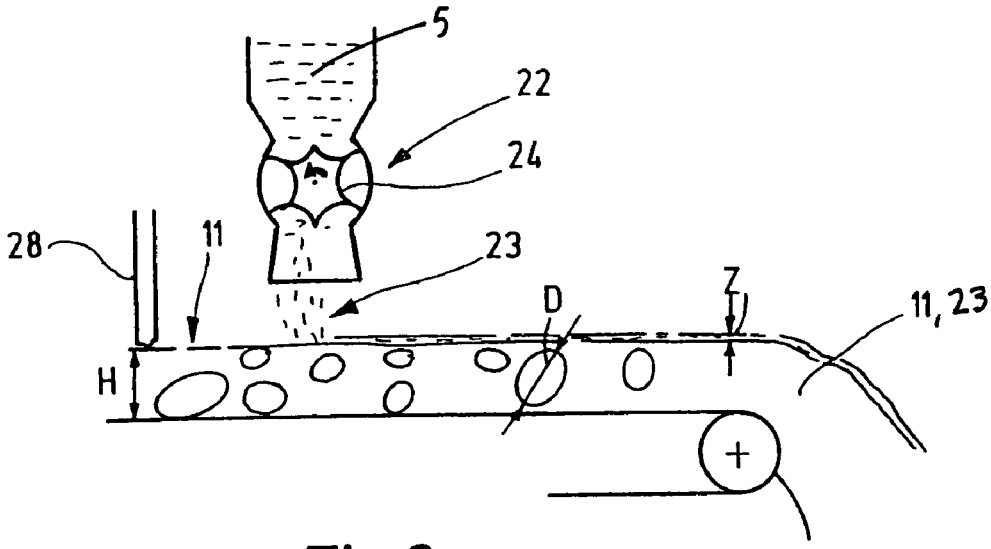
FIG. 3 depicts a detail of the apparatus of FIG. 1.

At the discharge position 18 of the homogenizing and separating device 12, a discharge device 26 is provided, which serves the purpose of controlled ejection of the coarse component 3 occurring here. The discharge device 26 can for instance be formed by a motor-actuated slide 27 or a flap that opens an exit from time to time and closes it again, under the control of the control device 25. Instead of the slide 27, however, if needed, a open exit can be provided, through which the coarse components 3 that occur here are output constantly. To create a uniform layer height of mixture of material 2 and thus a constant stream of material 11 on the belt conveyor 8, a slide 28 is provided above the belt conveyor 8; this slide is either fixedly set or is separably adjustable either via a motor under the control of the control device 25 or by hand. As FIG. 3 shows, the slide 28 creates a layer of mixture of material of height H; the height H is determined by the spacing of the lower edge of the slide 28 from the conveyor belt. The height H is dimensioned such that it just slightly exceeds the greatest diameter D of the coarse component 3. It is at least as great as the spacing between the rollers 31.

In one embodiment, the slide 28 has a rotatably supported roller 28*a* on its underside, or a corresponding cylinder. It defines a feed chamber 29 above the belt conveyor 8; this chamber is filled with mixture of material 2 and is constantly refilled with the mixture of material 2. A moisture sensor 32 that is connected to the control device 25 protrudes into this feed chamber, at least in one embodiment. The control device uses the data obtained about the moisture or water content in the mixture of material to meter the appropriate quantity of added material.

In one embodiment, a coarse separator, for instance in the form of a roller grate 30 with driven rollers 31, is provided in or above the feed chamber 29. The roller grate 30 is set or arranged such that overly coarse components 3*a* of material do not reach the conveyor belt 8 and instead are excluded. To that end, the rollers 31 are disposed at appropriate spacings from one another. These overly coarse components 3*a* of material are those whose size exceeds the height of the slit defined by the slide 28 and the conveyor belt 8. The roller grate 30 serves to discharge the coarsest components 3*a* before further handling. Laterally beside the roller grate 30, there is an outlet flap 40, to enable discharging accumulated overly coarse components 3*a*.

Figure 6:
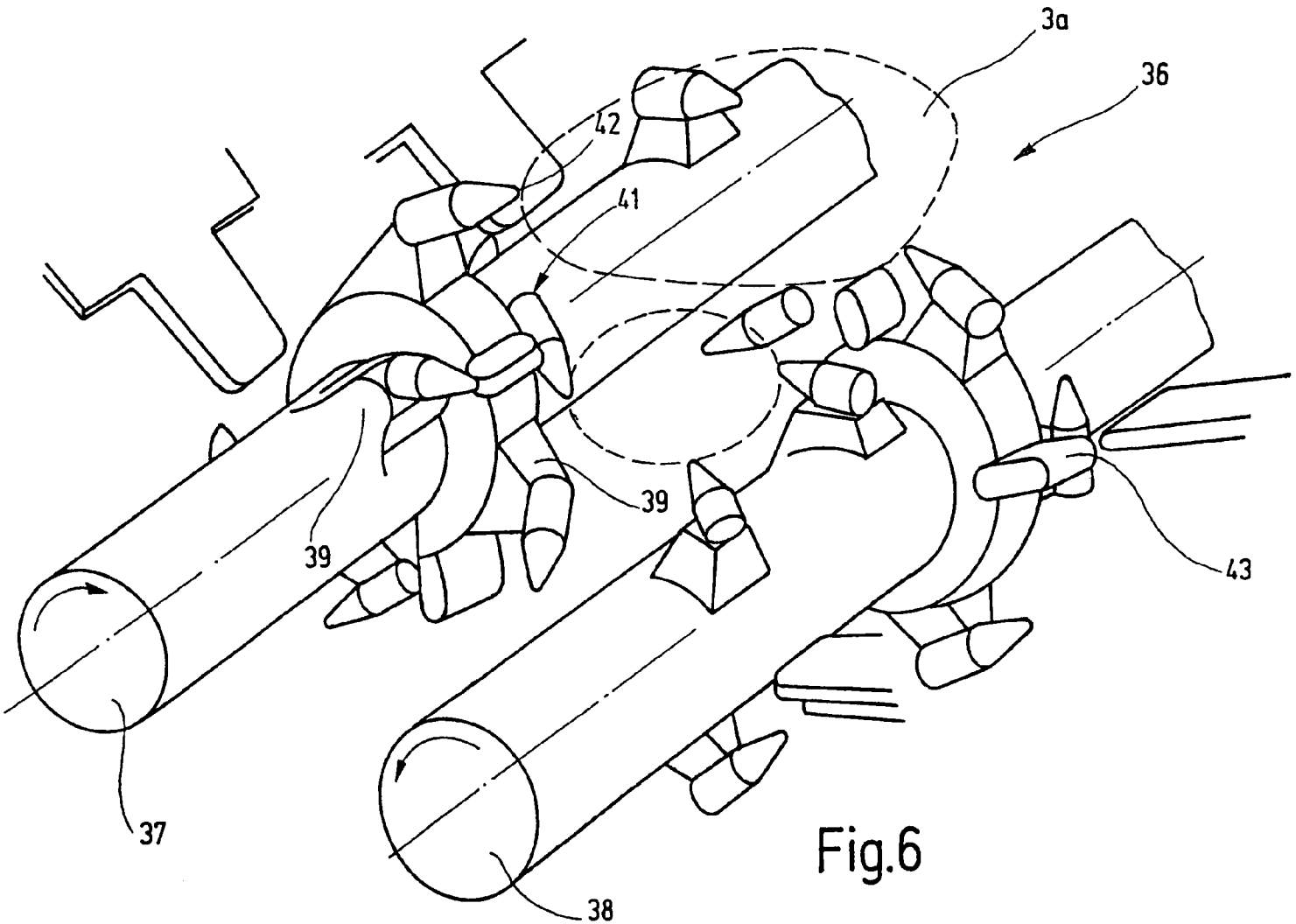
FIG. 6 depicts a perspective view of a splitter device for pretreating the mixture of material.

Instead of the roller grate 30 for discharging the coarsest component 3*a*, a splitter or breaker device 36 may be provided as shown in FIG. 6. In that case, the coarsest component 3*a* is not discharged, but is comminuted instead. The splitter 36 has at least two shafts 37, 38, which are parallel to one another and driven to rotate in the same direction, and which on corresponding arms 39 carry wedge elements 41. The wedge elements 41 are grouped in sets mounted on different diameters, and are oriented obliquely to the radial direction and obliquely to the circumferential direction. The spacings between the shafts 37, 38 and their wedge elements 41 are adjusted such that fine and medium-coarse components up to a diameter of about 200 mm are fed downward between the rollers 37, 38 without comminution. Each of the wedge elements 41 has a tip 42 for introduced force in pointwise fashion into the material to be broken, and they serve to split the very large components 3*a*(coarsest component, that is, stones or pieces of rock whose diameter is greater than the maximum layer thickness on the conveyor belt of the delivery device). Such a splitter 36 is preferably arranged to limit the maximum particle size to approximately 200 mm, or in other words to split up larger parts accordingly and feed smaller material onward unaffected. Buckets 43 can also be provided on the shafts, for improved conveyance of fine components through the spaces between the shafts 37, 38.

A splitter 36 of this kind can also be provided immediately following the roller grate 30, if the coarsest components 3*a* that have been separated out by the roller grate are to be split and separately processed only intermittently.

Figure 2:
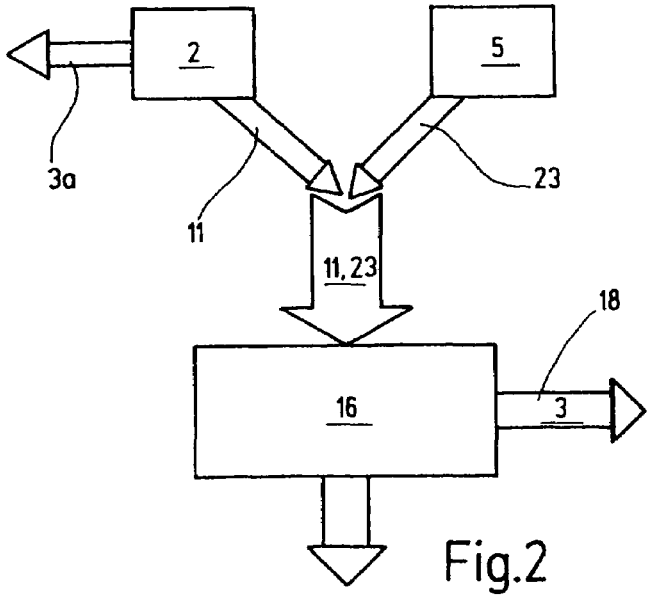
FIG. 2 depicts the separation process, in the form of a flowchart.

The processing apparatus 1 described thus far functions as follows:

For processing the mixture of material 2, this mixture is fed constantly into the feed chamber 29. The belt conveyor 8, forming a constant layer thickness, conveys the mixture of material 2 as a stream of material 11 (FIG. 3) into the homogenizing chamber 16. The control device 25 sets the rotary speed of the cell wheel 24 in accordance with the water content in the mixture of material 2, measured via the moisture sensor 32, or in accordance with some suitable specification. The result is a uniform layer of thickness Z, comprising added material 5, in the stream of material 11. Quicklime (CaO) is used here as the added material, for example. Depending on the water content of the mixture of material, approximately 2 to a maximum of approximately 15% of added material in proportion to the mixture of material 2 is used. In this way, the stream of material 11 and the stream of material 23 are united, as shown in FIG. 2, into one common stream of material 11, 23 and thus delivered as a uniform stream of material to the homogenizing and mixing chamber 16. The homogenization of the mixture of material and the separation of the individual components are done in a single method step. If needed, it can be provided that the coarsest components 3*a* be separated out of the mixture of material 2 and discharged from the feed chamber 29.

By the circulating action of the shafts 14 and the separator elements 15 connected to them, mixing and thus homogenization already occur in the vicinity of the infeed position 17, in the process of which the added material 5 is intimately mixed in particular with the fine component 4. Along the way from the infeed position 17 to the discharge position 18, the degree of homogenization increases, and as a result a consistency is established that allows a separation of the fine component 4 from the coarse component 3. Accordingly, the mixture 6 comprising fine component 4 and added material 5 is fed through the interstices between the shafts 14 and downward, while the coarse component 3, virtually entirely freed of fine component 4, arrives at the discharge position 18.

Here, it can be discharged continuously, or periodically.

If the separation is to be improved, or if separation is difficult for other reasons, then work can be done discontinuously in part, by periodically or from time to time reversing the direction of rotation of the shafts 14. The belt conveyor 8 can be briefly stopped at those times or can continue to run. By means of the reversal, the material separation can be still further reinforced under some circumstances, especially if the fine component 4 is very cohesive.

As a result of the method described, two re-usable products are produced at the same time, namely the coarse components 3 (stones, gravel, pieces of rock or the like) separated out of the mixture of material, and the fine component 4 in the form of the mixture 6 in which it is mixed with added material 5, such as cement, lime, fibers or other added materials. Disproportionately coarse components 3*a* are already excluded from the feed bin by the roller grate 30 and discharged separately. They can be used uncomminuted or can be delivered to a comminuting system (such as a rock breaking system). The mixture 6 of suitable added materials 5 can be recycled, for instance as filler material for trenches, pits or ditches or the like.

In a modified embodiment, which is shown in FIG. 5, the shafts 14 are connected to ellipse-shaped separator elements 15'. These elements are each offset by 90° from one another on a shaft 14, as can be seen in FIG. 5 on the left for the separator elements 15'a and 15'b. In addition, the separator elements of adjacent shafts 14, which pits are adjacent one another in the feeding direction F, are offset from one another, once again by 90°. The separator elements 15' can be provided as needed with chisels 33, 34, which can promote both homogenization of the mixture of material and its separation into its coarse and fine components.

This type of homogenizing and separating device 12 results in an enhanced transporting action and good cutting action for separating the coarse components 3 and fine components 4 from one another.

In a method for processing mixtures of material which contain a coarse component 3 and a predominantly cohesive fine component 4, both the mixture of material 2 and an added material 5 are delivered in continuous streams of material 11, 23, respectively, to a homogenizing and separating device 12. The homogenizing and separating device 12 serves to mix the added material 5 and the mixture of material 2 uniformly with one another, so as to put the fine component 4 of the mixture of material 2 into a state such that the fine components 4 can be separated from the coarse component 3. As a result of the continuous delivery of mixture of material 2 and added material 5 to the homogenizing and separating device 12, and intimate mixing of the added material 5 and fine component 4 is achieved, so that the separation of the coarse component 3 and fine component 4 can take place directly in the same device. With this method, mixtures of material 2 can be processed without waste in a single method into two re-usable products.

The invention has been described in detail with respect to various embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

The invention claimed is:

1. A method for processing a mixture of material, comprising:

continuously delivering the mixture of material to a homogenizing and separating device;

simultaneously and continuously delivering an added material to the homogenizing and separating device;

metering the added material on the basis of the water content in the mixture of material;

mixing the added material with the mixture of material; and during the mixing, separating out one component of the mixture of material, wherein the homogenizing and separating device operates continuously.

2. The method of claim 1, wherein the mixture of material contains a coarse component and a fine component; with the fine component being formable and moldable depending on its moisture content.

3. The method of claim 1, wherein the quantity of material present in the homogenizing and separating device is constant.

4. The method of claim 1, wherein the added material is a material that regulates moisture, or a moisture-absorbing material.

5. The method of claim 1, wherein the added material is a chemical additive.

6. The method of claim 1, wherein the added material is a binder.

7. A method for processing a mixture of material, comprising:

continuously delivering the mixture of material to a homogenizing and separating device, wherein the mixture of material contains a coarse component and a fine component; with the fine component being formable and moldable depending on its moisture content;

simultaneously and continuously delivering an added material to the homogenizing and separating device;

adjusting a stream of added material on the basis of a stream of the mixture of material;

mixing the added material with the mixture of material; and during the mixing, separating out one component of the mixture of material, wherein the homogenizing and separating device operates continuously.

8. The method of claim 7, wherein said adjusting is based on the moisture of the mixture of material and is further based on the size of the stream of the mixture of material, such that adhesion of the fine component to the coarse component is lessened.

9. A method for processing a mixture of material, comprising:

continuously delivering the mixture of material to a homogenizing and separating device;

simultaneously and continuously delivering an added material to the homogenizing and separating device, wherein the mixture of material and the added material each form a respective stream of material;

uniting the respective streams of material upstream of the homogenizing and separating device to form a common stream of material and delivering the common stream of material to the homogenizing and separating device, wherein the stream of the mixture of material has a layer height which is less than the height of the common stream of material, and the added material is applied as a layer to the mixture of material;

mixing the added material with the mixture of material; and during the mixing, separating out one component of the mixture of material, wherein the homogenizing and separating device operates continuously.

10. An apparatus for performing the method of claim 1, comprising:

a homogenizing and separating device for homogenizing streams of material delivered thereto, and for separating out a coarse component;

a material delivery device for continuous delivery of a stream of the mixture of material to the homogenizing and separating device;

an added material metering device for controlled, continuous delivery of the added material to the homogenizing and separating device; and a control device for controlling at least the added material metering device; the control device connected to one of a group consisting of a sensor device for detecting the moisture in the mixture of material and an input device for entering the desired quantity to be added.

11. The apparatus of claim 10, wherein the homogenizing and separating device further comprises a plurality of rotatably supported shafts disposed parallel to one another and connected to a drive mechanism; and a plurality of separator elements disposed on said plurality of rotatably supported shafts.

12. The apparatus of claim 11, wherein the separator elements are fixed on the shafts in a manner which prevents relative rotation therebetween, the shafts forming a feed path defining a predominantly horizontal feeding direction; and wherein the material delivery device is disposed on an upstream end of the feed path, and the apparatus further comprising a discharge device for the coarse component disposed on a downstream end of the feedpath.

13. The apparatus of claim 12, wherein the separator elements are circular disks.

14. The apparatus of claim 12, wherein the separator elements are nonround bodies.

15. The apparatus of claim 12, wherein the separator elements have protrusions thereon.

16. The apparatus of claim 11, wherein the drive mechanism is embodied such that the shafts are driven in the same direction, the drive mechanism operative to intermittently change the direction of rotation of the shafts and change the rotary speed of the shafts.

17. The apparatus of claim 10, further comprising a control device for controlling at least the added material metering device; the control device connected to one of a group consisting of a sensor device for detecting the moisture in the mixture of material and an input device for entering the desired quantity to be added.

18. The apparatus of claim 10, wherein the added material metering device is disposed on the material delivery device in order to carry the added material jointly with the stream of the mixture of material to the homogenizing and separating device.

19. The apparatus of claim 10, wherein the material delivery device further comprises a roller grate operative to discharge overly coarse components of material.

20. The apparatus of claim 19, further comprising a discharge device in the form of a controlled flap disposed on the roller grate.

21. The apparatus of claim 19, wherein the roller grate is adjustable in its orientation.

22. The apparatus of claim 19, wherein the roller grate is reversible in direction.

23. The apparatus of claim 10, wherein the material delivery device further comprises a belt conveyor having an adjustable feeding speed, in order to deliver the stream of the mixture of material to the homogenizing and separating device.

24. The apparatus of claim 23, further comprising a slide disposed above the belt conveyor for defining a feeding layer height; the slide including a rotatable shaft on an underside thereof.

25. The apparatus of claim 23, wherein the belt conveyor is a feed-belt weigher.

26. The apparatus of claim 10, wherein the metering device is controlled based on the stream of the mixture of material fed by the material delivery device.

27. The apparatus of claim 10, wherein the material delivery device includes a splitter device for comminuting components of material whose dimensions exceed a predetermined limit, and which allows material components whose dimensions are less than the limit to pass onward.

28. The apparatus of claim 27, wherein the splitter device includes at least two shafts driven in contrary directions, the shafts having free-standing splitting wedges secured thereto.

* * * * *